United States Patent [19]

Sullivan et al.

[11] 4,269,216

[45] May 26, 1981

[54] PRESSURE DEMAND VALVE SYSTEM

[75] Inventors: John L. Sullivan, Fort Erie, Canada; Eugene A. Georgini, Cheektowaga; Milo R. Simmonds, Williamsville, both of N.Y.

[73] Assignee: A-T-O Inc., Willoughby, Ohio

[21] Appl. No.: 926,005

[22] Filed: Jul. 19, 1978

[51] Int. Cl.[3] ..... A62B 7/04

[52] U.S. Cl. ..... 137/102; 137/DIG. 9; 128/200.24

[58] Field of Search ..... 137/102, DIG. 9; 128/142.2

[56] References Cited

U.S. PATENT DOCUMENTS

| | | | |
|---|---|---|---|
| 2,695,609 | 11/1954 | Nourse et al. | 137/DIG. 9 |
| 3,070,108 | 12/1962 | Fischer | 137/DIG. 9 |
| 3,145,721 | 8/1964 | Miller | 137/DIG. 9 |
| 3,724,482 | 4/1973 | Ekstrom | 137/DIG. 9 |
| 4,029,120 | 6/1977 | Christianson | 137/DIG. 9 |

FOREIGN PATENT DOCUMENTS

| | | | |
|---|---|---|---|
| 648558 | 9/1962 | Canada | 137/DIG. 9 |

*Primary Examiner*—William R. Cline

*Attorney, Agent, or Firm*—Christel, Bean & Linihan

[57] ABSTRACT

A respirator having a combination demand air regulator to provide air to the user on demand and an exhaust check valve. The regulator diaphragm, by its inward movement during inhalation, causes the exhalation valve to close while regulating the intake of supply air. Conversely, the regulator diaphragm, by its outward movement during exhalation, causes the exhalation valve to open while keeping the demand valve closed.

9 Claims, 5 Drawing Figures

PRESSURE DEMAND VALVE SYSTEM

BACKGROUND

This invention relates to protective breathing apparatus of the type of which a user wears a face mask connected to a source of air for use in toxic or oxygen deficient surroundings. More specifically, the subject matter is a combination demand air intake regulator and exhalation valve for such a breathing apparatus.

Typically, in the prior art, respirator systems have included air intake regulators and exhalation valves as separate components, separately mounted to a face mask. Such prior art arrangements have required separate apertures in the face mask and some redundancy in hardware for the separate valves.

The details, operation, and benefits of the present invention will now be described with reference to the accompanying drawing.

DRAWING

DESCRIPTION

Figures 1, 2, 3:
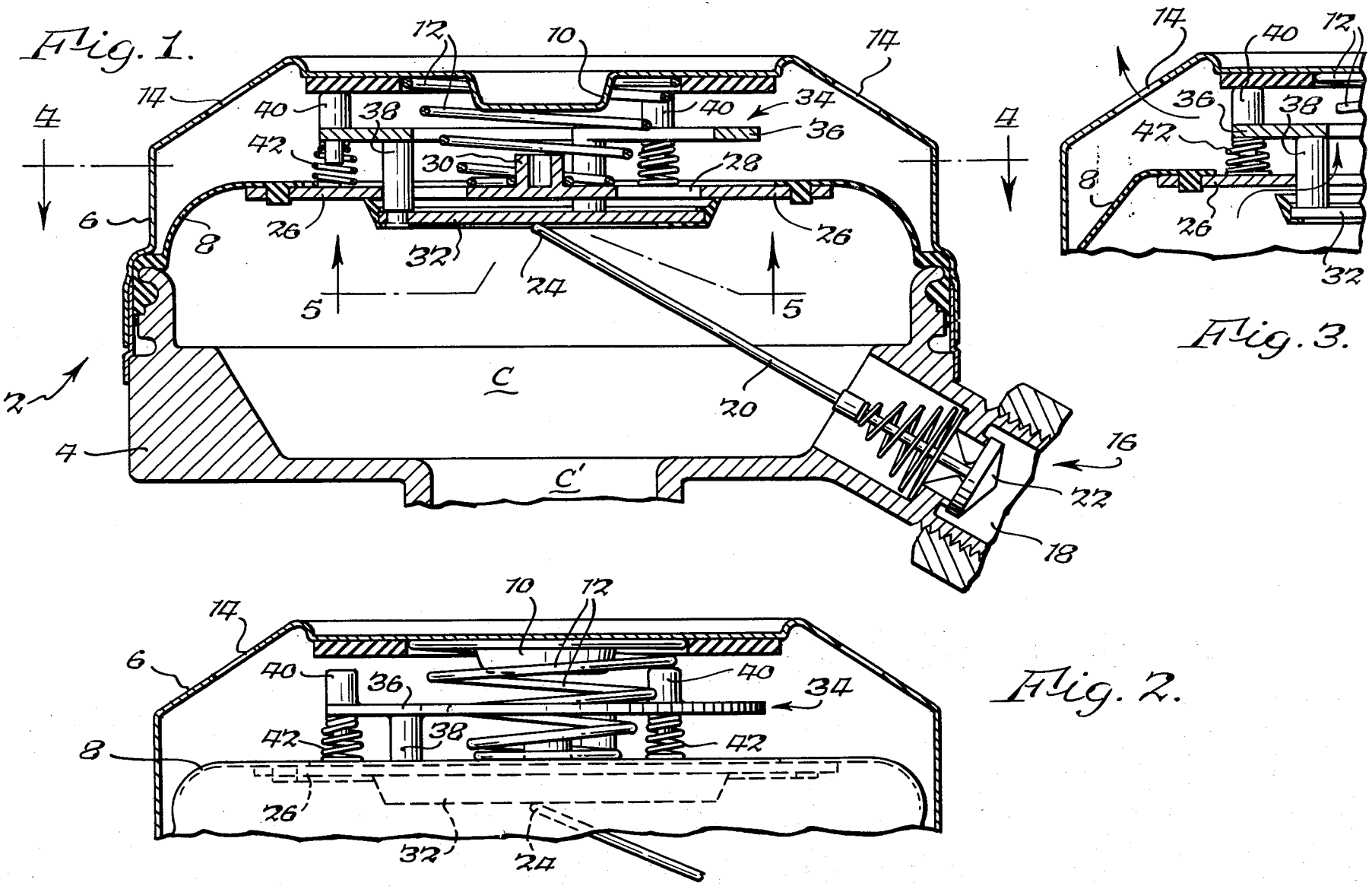
FIG. 1 is a sectional view of a combination inhalation regulator and exhalation valve according to this invention, in an instantaneous condition during exhalation when all valves are closed.
FIG. 2 is a partial view of the same inhalation regulator, exhalation valve in its condition during inhalation.
FIG. 3 is a partial view of the same inhalation regulatorexhalation valve in its condition during exhalation.
Figure 5:
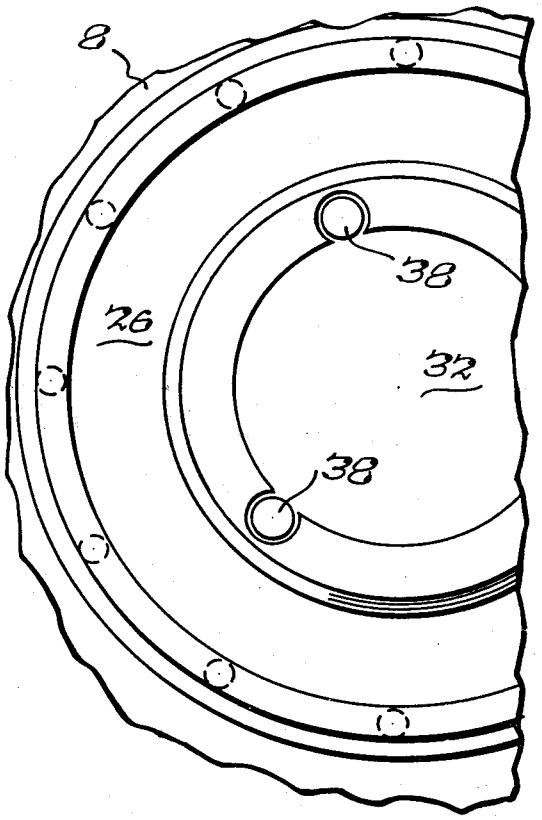
FIG. 5 is a sectional view taken along the line 5—5 of FIG. 1.

Referring now to FIG. 1, an inhalation pressure demand regulator and exhalation valve, hereinafter "regulator" for short, is generally indicated at 2 and includes a body 4 and a cover 6. A flexible diaphragm 8 of silicone rubber or the like is secured around the periphery of body 4 and cover 6 and extends across the interior of the regulator, defining with body 4 an air chamber C therein. Regulator 2 is adapted to fit to a face mask so that air chamber C communicates with the mask interior or mask chamber C indicated at the broken away bottom portion of FIG. 1.

Regulator cover 6 includes a central indentation 10, forming a spring seat around which a conical spring 12 is seated and adapted to bear in compression against the cover 6. Cover 6 also includes a plurality of vent apertures 14 through which the atmosphere chamber of the regulator, between cover 6 and diaphragm 8, communicates with atmosphere.

A demand air valve 16 is mounted on the body 4 of the regulator to admit air on demand into the air chamber C from a pressure air supply line, indicated at 18. Demand valve 16 operates in a known manner, as more fully described in U.S. Pat. No. 3,145,721 to Miller. It suffices for the purpose of this description to summarize that valve 16 includes a valve stem 20 which extends from a valve member 22 to a stem head 24 which follows the displacement of diaphragm 8 to tilt the valve member 22, regulating the admission of air from air line 18.

Figure 4:
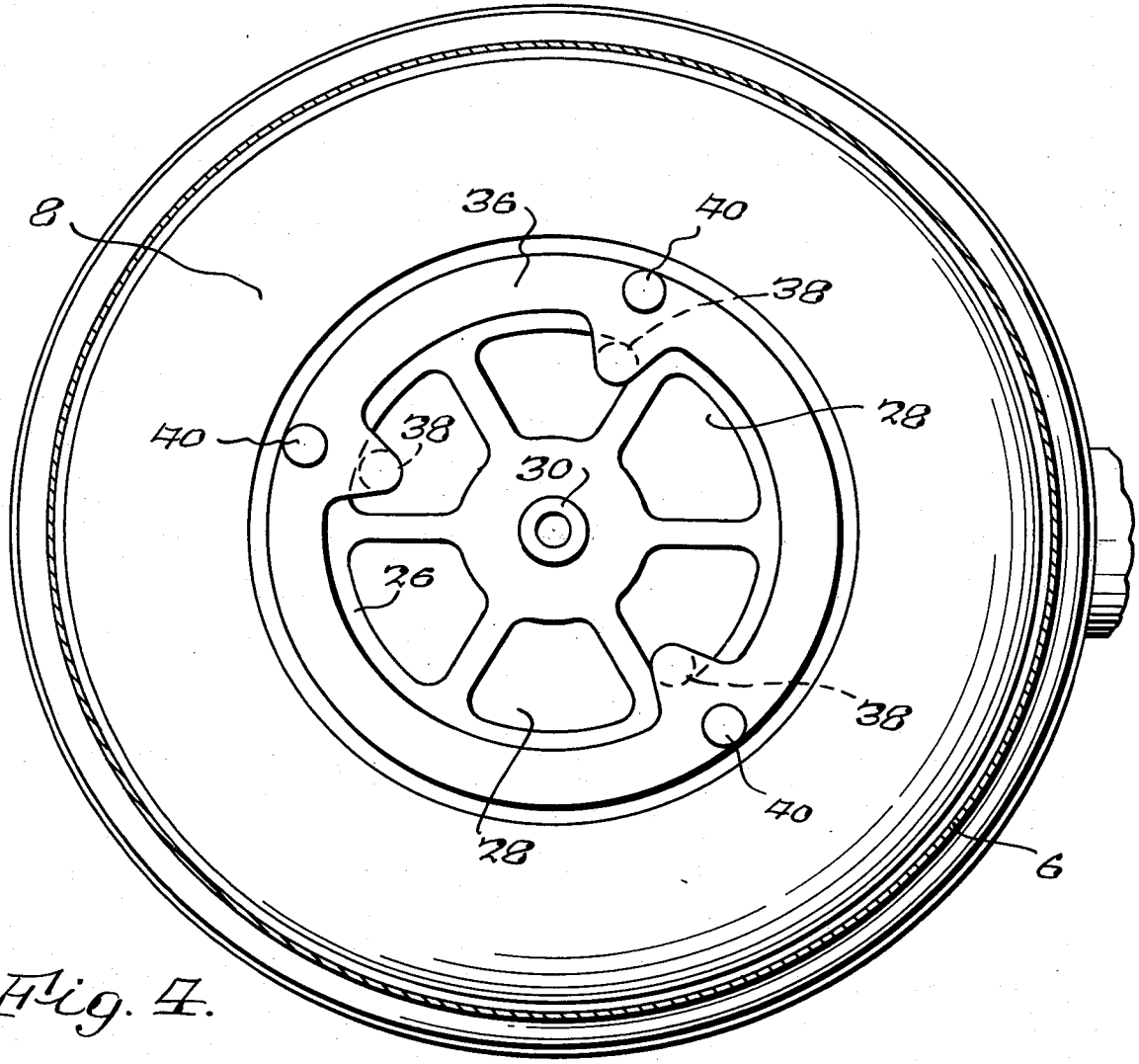
FIG. 4 is a sectional view taken along the line 4—4 of FIG. 1.

Diaphragm 8 is flexible in order to float within the regulator body under the influence of the breathing of the user. That is, inhalation draws the diaphragm inward, or downward in the drawing, and exhalation pushes the diaphragm outward, upward in the drawing. The central portion of the diaphragm 8 is a rigid circular diaphragm plate 26, generally open and spoked in the center (FIG. 4) forming several aperture sectors 28 about a hub 30. Conical compression spring 12 is positioned between the cover 6, where it is centered around spring seat 10, and diaphragm 26 where it is centered around hub 30.

A rigid circular disc valve seat 32 is coaxial with diaphragm plate 26 and adapted to overlie aperature sectors 28 to open and close the same. A valve guide 34 is fixed to valve seat 32 and includes a central ring 36 with three seat legs 38, passing through apertures 28, to which valve seat 32 is mounted and three abutment legs 40 projecting outward the cover 6 of the regulator. Valve guide 34 with integral valve seat 32 is mounted to the diaphragm plate 26 by light compression springs 42, one fastened on each abutment leg 40. Valve guide 34 and valve seat 32 are biased by springs 42 in a light sealing position against diaphragm plate 26 and over the aperture sectors 28. The stem head 24 of demand air valve 16 bears on the valve seat 12.

OPERATION

As a reference or starting condition, consider the system at equilibrium with pressure in chamber C equal to ambient atmosphere. In this condition, spring 12 (which is adjustable though this is not shown for simplicity) holds diaphragm 8, and valve guide 34 with it, away from the abutment position of legs 40. That is legs 40 and valve guide and seat 34 and 32 are at some intermediate position between those shown in FIGS. 1 and 2. This pre set bias of spring 12 on the diaphragm and thereby on the member 32 is for the purpose of holding valve stem 20 and demand valve 16 at some open position. In other words, an equilibrium pressure condition is not tolerated by the system-pressure equilibrium creates mechanical demand for air from valve 16 until there is a positive pressure in chamber C, an imbalance to move the diaphragm 8 and valve guide and seat 34, 32 to their FIG. 1 positions. Thus a positive pressure is maintained in chamber C to prevent atmosphere inflow.

Next, consider this system at an instantaneous condition during exhalation as shown in FIG. 1 at which point, the user has exhaled some air and the increased pressure in air chamber, relative to ambient pressure, has moved the diaphragm 8 against the compression spring 12 to the position shown where legs 40 abut the cover, demand valve 16 is just closed and exhalation valve 32 still seated.

Now, during further exhalation by the user, as represented in FIG. 3, the diaphragm plate 26 is pushed upward with valve guide and seat 34, 32 held from further movement by the abutment of legs 40 against cover 6. While valve seat 32 is thus stopped, the further upward travel of diaphragm plate 26 against spring 12 opens the valve seat 32 for exhalation flow to ambient atmosphere as represented by the arrows. The demand air valve 16 remains closed here as it is in FIG. 1.

Next, during inhalation by the user, as represented in FIG. 2, the diaphragm plate 26 with valve guide 34 and valve seat 32 is drawn downward by the temporary drop in pressure in air chamber C. Exhalation valve seat 32 remains closed on the diaphragm plate 26 by the biasing action of springs 42. Downward moving valve seat 32, bearing against the stem head 24 of demand air valve 16, causes tilting of the stem and opening of the air valve 16 to allow demand air into the chamber C. As demand air raises the pressure in chamber C above that of ambient atmosphere (on the other side of diaphragm 8) the chamber C moves back against diaphragm 8 and spring 12 toward its FIG. 1 condition.

SUMMARY

To summarize the operation of this invention, the repeated cycle includes: 1. inhalation, FIG. 2, during which exhalation valve 32 is closed and demand air valve 16 is regulating, 2. exhalation, FIG. 1, during which demand air valve 16 reaches closing and exhalation valve 32 remains closed while positive mask pressure develops, and 3. exhalation, FIG. 3, during which demand air valve 16 remains closed and exhalation valve 32 is exhausting to atmosphere.

The present invention provides an effective, single apparatus which is a combination inhalation demand air regulator and exhalation valve.

The foregoing description and summary of this invention are given only by way of illustration and not of limitation. The concept and scope of the invention are limited by the following claims.

What is claimed is:

1. A combination inhalation demand air regulator and exhalation valve for a respiration mask including:

(a) a body and a cover defining a cavity, said body being apertured to communicate with the mask interior and said cover being vented to atmosphere, (b) a diaphragm disposed across said cavity defining with said body an air chamber and with said cover an atmosphere chamber, said diaphragm being movable inwardly relative to a neutral position during inhalation and outwardly relative to said neutral position during exhalation, said diaphragm having a portion including at least one aperture for effecting communication between said air chamber and said atmosphere chamber, (c) means responsive to the position of said diaphragm inward of said neutral position to regulate air flow from a supply line into said air chamber, and (d) means responsive to the position of said diaphragm outward of said neutral position to effect communication through said diaphragm aperture to said air chamber with said atmosphere chamber to exhaust said air chamber to atmosphere comprising a valve seat, means for holding said valve seat on said diaphragm in a manner permitting said valve seat to close said diaphragm aperture and permitting independent relative movement between said diaphragm and valve seat during exhalation and means for limiting movement of said valve seat relative to said diaphragm whereby during exhalation, said valve seat and diaphragm are moved together with said valve seat closing said diaphragm aperture to a point where further movement of said valve seat is prevented and said diaphragm is moved away from said valve seat to open said aperture to exhaust said air chamber to atmosphere.

2. A combination inhalation demand air regulator and exhalation valve for a respirator mask as set forth in claim 1, wherein said means to regulate air flow include a demand air intake valve mounted to said body and adapted to admit air from a supply line to said air chamber when demand therefor is sensed, said intake valve operatively engaging said diaphragm and responsive to the position thereof inward of said neutral position to regulate the flow of air through said intake valve.

3. A combination inhalation demand air regulator and exhalation valve for a respirator mark as set forth in claim 1, wherein said valve seat is located on the air chamber side of said diaphragm.

4. A combination inhalation demand air regulator and exhalation valve for a respirator mark as set forth in claim 1 wherein said valve seat is rigid.

5. A combination inhalation demand air regulator and exhalation valve for a respirator mask including:

(a) a body and a cover defining a cavity, said body being apertured to communicate with the mask interior and said cover being vented to atmosphere;

(b) a diaphragm disposed across said cavity defining with said body an air chamber and with said cover an atmosphere chamber, said diaphragm being movable inwardly relative to a neutral position during inhalation and outwardly relative to said neutral position during exhalation, said diaphragm having a portion comprising a rigid apertured plate which is part of and moveable with said diaphragm;

(c) means responsive to the position of said diaphragm inward of said neutral position to regulate air from a supply line into said chamber;

(d) a rigid valve seat resiliently mounted on said plate for movement therewith and positioned on the air chamber side of said diaphragm, said rigid valve seat normally extending over said apertured portion of said diaphragm, said rigid valve seat being responsive to the position of said diaphragm outward of said neutral position to effect communication through said diaphragm to said air chamber with said atmospher chamber exhausting said air chamber to atmosphere, said rigid apertured plate of said diaphragm being capable of outward movement independent of said rigid valve seat; and (e) means responsive to the position of said diaphragm outwrd of said neutral position to effect communication through said diaphragm to said air chamber with said atmosphere chamber to exhaust said air chamber to atmosphere, said means comprising abutment means on the atmosphere chamber side of said diaphragm and rigidly connected to said rigid valve seat for limiting outward movement of said rigid valve seat and concurrently permitting outward movement of said diaphragm independently of said rigid valve seat to permit air flow between said air chamber and said atmosphere chamber through said apertured portion of said diaphragm, and (f) said means to regulate air flow comprising a demand air intake valve mounted to said body and adapted to admit air from a supply line to said air chamber when demand therefor is sensed, said intake valve operatively engaging said valve seat and responsive to the position of said valve seat inward of its abutment position with said cover to regulate the flow of air through said intake valve.

6. A combination inhalation pressure demand air regulator and exhalation valve for a respirator mask as set forth in claim 1, 2 or 5, including means to urge said diaphragm inward of said neutral position so that said air flow regulating means calls for air until said diaphragm finds said neutral position.

7. A combination regulator and valve as defined in claim 6 in which said last-named means includes an adjustable spring by which to adjust the inward bias against said diaphragm.

8. A combination inhalation demand air regulator and exhalation valve for a respirator mask including:

(a) a body and a cover defining a cavity, said body being apertured to communicate with the mask interior and said cover being vented to atmosphere;

(b) a diaphragm disposed across said cavity defining with said body an air chamber and with said cover an atmosphere chamber, said diaphragm being movable inwardly relative to a neutral position during inhalation and outwardly relative to said neutral position during exhalation, said diaphragm having a central portion comprising a rigid apertured plate;

(c) means responsive to the position of said diaphragm inward of said neutral position to regulate air flow from a supply line into said air chamber;

(d) valve means carried by and through said diaphragm and positioned on the air chamber side of said diaphragm, said valve means normally extending over said apertured portion of said diaphragm, said valve means being responsive to the position of said diaphragm outward of said neutral position to effect communication through said diaphragm to said air chamber with said atmosphere chamber exhausting said air chamber to atmosphere, said rigid apertured plate of said diaphragm being capable of outward movement independent of said valve means; and (e) stop means located on the atmosphere chamber side of said diaphragm rigidly connected to said valve means carried by and through said diaphragm and cooperating with said body for limiting outward movement of said valve means carried by and through said diaphragm to permit air flow between said air chamber and said atmosphere chamber through said apertured portion of said diaphragm.

9. A combination inhalation demand air regulator and exhalation valve for a respirator mask as set forth in claim 8 further including spring means disposed between said diaphragm and said cover on the atmosphere chamber side of said diaphragm to urge said diphragm inward of said neutral position so that said air flow regulating means calls for air until said diaphragm finds said neutral position.

* * * * *

UNITED STATES PATENT AND TRADEMARK OFFICE

CERTIFICATE OF CORRECTION

PATENT NO. : 4,269,216

DATED : May 26, 1981

INVENTOR(S) : John L. Sullivan, Eugene A. Giorgini, Milo R. Simmonds

It is certified that error appears in the above-identified patent and that said Letters Patent are hereby corrected as shown below:

On the title page, Item /76/
Change inventor's name from "Eugene A. Georgini"

to --Eugene A. Giorgini--.

Signed and Sealed this

*Eighth* Day of *September 1981*

[SEAL]

*Attest:*

GERALD J. MOSSINGHOFF

*Attesting Officer* *Commissioner of Patents and Trademarks*